US009914031B2

(12) United States Patent
Vrhel et al.

(10) Patent No.: US 9,914,031 B2
(45) Date of Patent: Mar. 13, 2018

(54) GOLF TEE AND BEVERAGE CLOSURE COMBINATION

(71) Applicants: Ronn Vrhel, La Grange, IL (US); Charles Stumpf, Berwyn, IL (US)

(72) Inventors: Ronn Vrhel, La Grange, IL (US); Charles Stumpf, Berwyn, IL (US)

( * ) Notice: Subject to any disclaimer, the term of this patent is extended or adjusted under 35 U.S.C. 154(b) by 62 days.

(21) Appl. No.: 14/878,080

(22) Filed: Oct. 8, 2015

(65) Prior Publication Data

US 2017/0101234 A1 Apr. 13, 2017

(51) Int. Cl.
*A63B 57/10* (2015.01)
*B65D 81/36* (2006.01)

(52) U.S. Cl.
CPC ..... *A63B 57/10* (2015.10); *B65D 81/366* (2013.01); *A63B 2225/682* (2013.01)

(58) Field of Classification Search
CPC ..... B65D 51/24; A63B 57/10
USPC ..... 366/242; 215/44
See application file for complete search history.

(56) References Cited

U.S. PATENT DOCUMENTS 638,920 A 12/1899 Grant
1,949,902 A 3/1934 Desser
2,096,975 A 10/1937 Revson
3,122,357 A * 2/1964 Roch ..... B65D 51/32 366/242
3,797,658 A * 3/1974 Peacock ..... B65D 75/305 206/216
4,875,579 A 10/1989 Tak
4,916,672 A * 4/1990 McCrory ..... B01F 7/00583 366/130
5,759,119 A * 6/1998 Ayoub ..... B65D 85/36 206/525
2009/0008390 A1* 1/2009 Robinson ..... B65D 51/24 220/212
2011/0198355 A1 8/2011 Mullen

* cited by examiner

*Primary Examiner* — Anthony Stashick
*Assistant Examiner* — Raven Collins
(74) *Attorney, Agent, or Firm* — Alex Shtraym

(57) ABSTRACT

A golf tee and beverage cap combination comprises a tubular concave twist off cap, having different methods of securement to containers, extending from its bottom a tapering member that ends in a pointed tip. The beverage cap and golf tee can either be one piece or connected to one another through a protruding member associated to the bottom of a beverage cap. The protruding member will comprise of a perforated section at its end that is loosely connected to the pointed tip of a golf cap. The pointed tip and protruding member easily detach from one another and retain their original objectives. If the beverage cap and golf tee are one piece, the top portion of the cap will be depressed to allow a user to rest a golf ball. The material used should allow the combined device to come in contact with any thing consumed by man.

4 Claims, 3 Drawing Sheets

Fig. 1
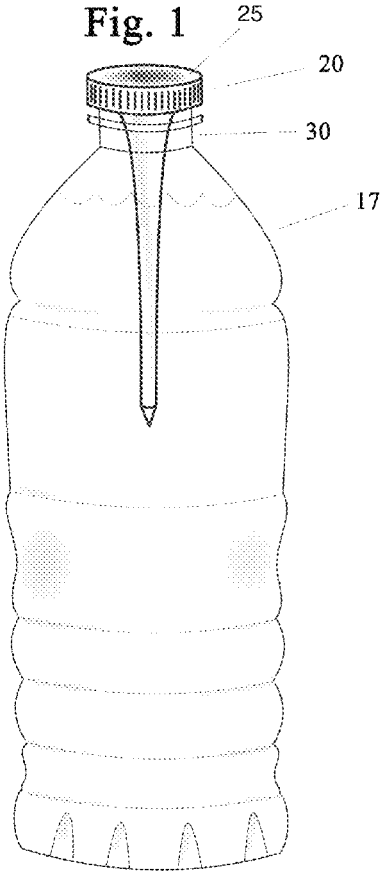
Fig. 2
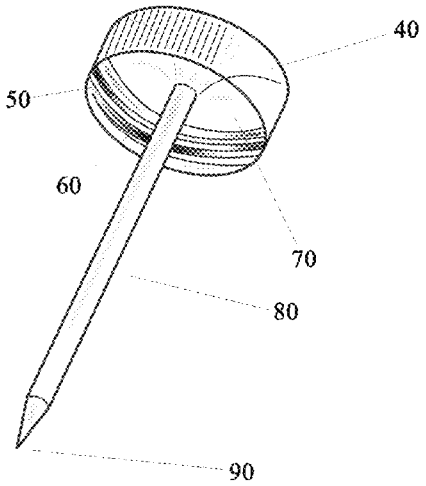
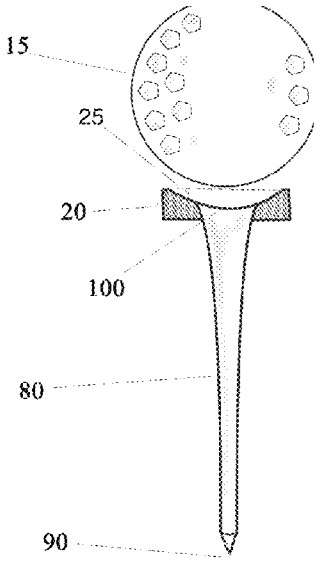
Fig. 3
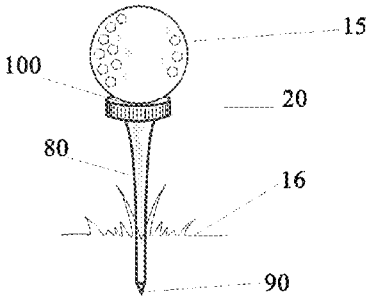
Fig. 4

120
130
110

120
165
160
190
150
140
180
195
200

140
150
190
180
195
200
120
140
150
190
180
195

15
195
180
190

Fig. 10
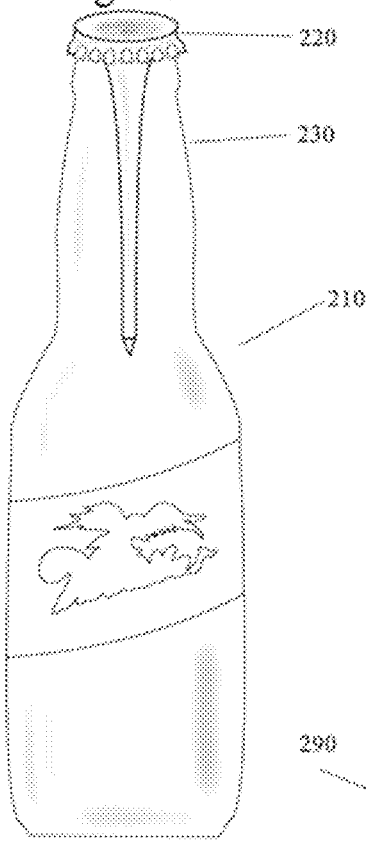
Fig. 11
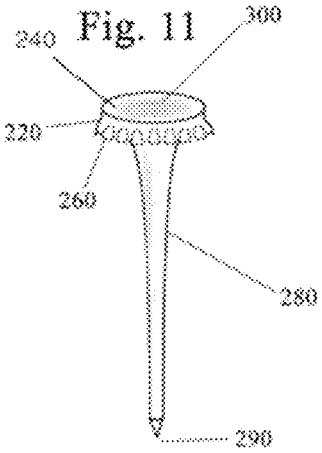
Fig. 12
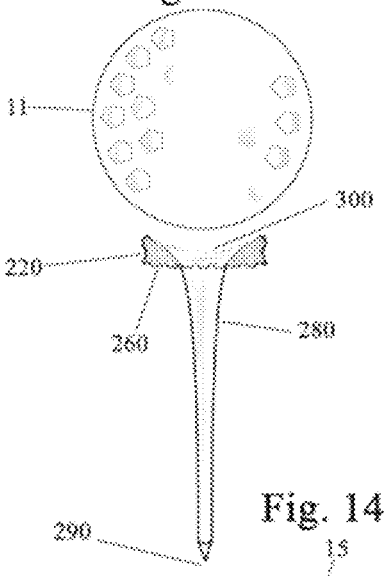
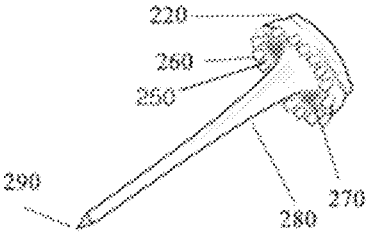
Fig. 13
Fig. 14
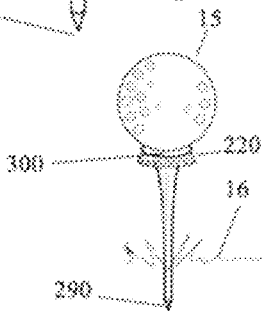

GOLF TEE AND BEVERAGE CLOSURE COMBINATION

CROSS-REFERENCE TO RELATED APPLICATIONS

None.

STATEMENT REGARDING FEDERALLY SPONSORED RESEARCH OR DEVELOPMENT

None.

BACKGROUND OF THE INVENTION

1. Field of the Invention

The present invention relates generally to equipment used during the game of golf. More particularly, this invention pertains to a golf tee that is combined with a closure for beverage drinks. The golf tee may be embedded into the actual cap of a beverage or may be separable and easily detached for use.

2. Background Art

Golf is one of the few ball games that do not require a standardized playing area. The game is played on a course with an arranged progression of either nine or 18 holes. Each hole on the course must contain a tee box to start from, and a putting green containing the actual hole. There are other standard forms of terrain in between, such as the fairway, rough, and hazards, but each hole on a course is unique in its specific layout and arrangement.

The game of golf most commonly requires three essential elements to play the game. These include a set of clubs, a golf ball and a tee that allows a player to hold the ball in position, off the ground, in order to attain a greater strike. Golf tees generally are packaged and sold separately from all other requisites of the game. Golf tees are most commonly made of wood or plastic, including a cup-like top and a tapering body forming a pointed end.

Arguably, beverages are just as essential as the above-mentioned products. Drinks are brought on the golf course for a number of different reasons ranging from entertainment to supporting a healthy body temperature and quenching thirst. What many golfers don't realize is that what, and how much, you drink are actually among the most important decisions you make on the golf course. Your choice can mean the difference between playing with energy, focus, and coordination, or can leave you suffering from fatigue, mood fluctuations and poor motor control. In extremely hot conditions, you can lose as much as two liters of water per hour. If those fluids are not replaced, the body becomes dehydrated, affecting virtually every system of your body. Your heart has to work harder, your muscles lose strength and flexibility, your brain function slows and you can experience cramping or dizziness, and even develop heat exhaustion or heat stroke. Beverages are consumed from a variety of different bottle shapes and sizes, preferably made of recyclable material to allow for easy clean up and potential environmental benefits.

What is not shown in the prior art heretofore known and what is needed in the field is a product that allows a consumer to purchase a single product with multiple essential requisites for golfers. The combination of a beverage container with a golf tee that allows immediate use of both products has not been previously available. Frequently, golfers forget to bring golf tees to the course due to their small demeanor. Further, no product in the market allows for a functional golfer's tool that is simultaneously sanitary and can be submerged in a liquid. Previous inventions allow for combinations of beverage caps with products that are associated with consumption or that are interrelated in some aspect with drinking. No previous products relate to the field of the endeavor or aim to solve the same problem of allowing simultaneous access to a golf related product through a beverage cap or closure.

For example, U.S. Pat. No. 3,122,357 published Feb. 25, 1964, entitled "Combined closure and mixer or stirrer" describes and illustrates a closure connected to a mixing device or stick. The device described therein has a stick including a ball shaped element or member embedded into the stopper. The closure is removed and the device is used for stirring or mixing drinks. Another embodiment includes a holder, rather than a member embedded into the stopper, which is interposed between the top section and upper edge of the neck. The holder includes a well section with an opening. Lastly, a short stub section may remain attached to the closure, so that the mixer can be broken off and used as a mixing stick for stirring or mixing drinks.

The structure disclosed above suffers from one or more disadvantages, for example, not having a concave head portion for placement of a golf ball or a connection between the closure and pointed tip. The present invention is intended to provide a combined beverage closure and golf tee using a novel structure solving many of the above noted problems.

SUMMARY OF THE INVENTION

The present invention is directed to a product for solving the above-identified problems and for meeting the needs of the industry by providing desirable features. The invention includes a beverage closure, i.e. a bottle cap, that is enhanced to include the necessary features of a golf tee while retaining its original objective of preventing spillage from the container it seals. The essential features of a golf tee include a cup-like top for placement of the golf ball and a tapering body. The tapering body of the golf tee will end with a pointed tip, which will be capable of breaching the ground and staying secure in place without breaking.

The beverage closure will retain its main purpose until the user decides to open the beverage and use the cap for different purposes. The top surface of the closure will be made in a concave, beveled, fashion in order to allow the user to place a conventional golf ball on top of the closure. The closure will support the golf ball and may be made of different diameters and depths, depending on product manufacturing and golf regulations. The outside sidewall of the closure will provide a holding surface, allowing easy gripping for the user to twist or pop off the cap. The inner sidewall of the beverage closure will be made in accordance with the specificities of the bottle it insulates. Such internal components of the sidewall may include, but are not limited to, grooves, teeth or screw threads.

The beverage closure will further extend, as one piece, from the inner center surface to form a tapering body member. The body member can be made in any desirable length, so long as it is not capable of transgressing upon the bottom of whichever bottle it is implanted into. The tapering end will have a sharp, pointed tip like most golf tees. The purpose of this end is to allow the user to breach a surface and create a stable support. The tee will need to be made of an approved material in order to be placed in beverages. While golf tees are most commonly inserted into the ground, this invention, due to materials used, will also allow users other advantages. Such other uses may include, but are not limited to, using the tee and closure combination as a skewer sandwich holder or in connection with placing fruit or vegetables in drinks.

The present invention does not require a special retainer for holding the device in place, rather it is adapted to make use of the container closure which is a necessary part of all screw threaded caps or the like that are used to close bottles so that the product will have a minimum cost, and will be easy to produce. The engineering of the invention will allow manufacturers to use their present equipment and methods for producing beverage closures. An indent will need to be made in order to create a concave head without imposing hardships or taking away from the integrity of the design of a beverage cap. An additional elongating member will be added to the process to extend away from the inner surface of the closure and end in a pointed tip. Just like current manufacturing standards, a machine will secure the golf tee beverage closure combination from a vertical position onto a beverage container opening. The motions of the manufacturing machines and assembly process will not affect the design of closure due to its solid state. The present invention is especially suitable for use on a glass bottle, such as a beer beverage, and the tee parts can be made of a material, which do not affected the contents of the bottle, in which it has contact with.

Further, this invention will have several marketing advantages as compared to previously produced products. Commonly, tees may have brand names and logos running down the tapering/body portion of the tee. However, due to the combination, this invention allows for marketing and branding on the concave, beveled, head portion of the closure due to the wider diameter that is associated with beverage caps. Although, the top of the closure will be indented, users will still be able to associate the product with a brand name or company, thus providing for immense promotional possibilities. Trademarks and other symbols will still be visible and understandable in accordance with the design of the beverage cap.

In another embodiment of the invention, a golf tee is inversely attached to the beverage closure through a loose connection between the pointed tip and the inner surface. Alternatively, the beverage closure will contain a protruding member extending from the inner surface of the bottle closure. The golf tee will be inversely positioned within the beverage container. Thus, the concave placement holder for the golf ball of the tee will be closer to the bottom of the container as compared to the closure, when in a secured position. The protruding member will end with a v-shaped perforated section that is connected to an object having the structure of a golf tee. The pointed tip of the tee will be loosely attached to the perforated section of the protruding member, which is coupled with the closure. A user of the product can simply open their beverage, pull out the golf tee and beverage cap combination and snap off the tee. The placement holder's diameter will be smaller than the neck of the container opening to ensure easy retraction of the tee. Further, the longitudinal length of the tee may vary so long as it is not longer than the actual container itself. Due to the provision of the perforated section, the golf tee can be broken off and separated from the closure, while retaining its shape, composure and utility. Most importantly, the pointed end will remain piercing in order to ensure easy breach of a surface. The inner sidewalls of the cap will have corresponding attachment to the actual container. Such attachment may be comprised of, but is not limited to, screws, lugs, threads, grooves or teeth. The beverage closure will still be able to seal the container after separation while the detached golf tee may be used to support a golf ball when positioned properly or pertain to other recreational uses.

The current embodiment does not require a protruding member. The pointed tip of the golf tee may be loosely attached to the inner surface of the closure. Using the same techniques as described above, the user can simply snap or twist off the golf tee from the closure cap and use each item for its intended purpose. Again, the tee will be inversely positioned within the container, so as to allow easier separation due to a smaller surface area needing detachment.

The manufacturing of this embodiment is similar to that of the previously mentioned above. A bottle manufacturing plant that produces beverage closures need inversely connect a golf tee to the inner surface of the closure with a loose, easily detachable, connection. Alternatively, the manufacturer may attach a protruding member from the inner surface of the closure. The protruding member will further have a v-shaped end and be loosely connected to a pointed tip of a golf tee. The placement head end of the tee will need to have a diameter that is less than the opening of the beverage container.

The present embodiment can be used with any type of closure in conjunction with a detachable cap container. Any type of detachable cap container can be used. For example a cap container may be a screw-on cap, a fringe teeth cap, a threaded cap or any other type of detachable cap. A container may be, for example, a bottle such as a plastic, glass, tin, ceramic, or aluminum bottle.

BRIEF DESCRIPTION OF THE DRAWINGS

The present invention will now be discussed in further detail below with reference to the accompanying figures in which:

FIG. 1 illustrates a perspective view of one embodiment of the device according to the present invention, with the device being attached to a plastic container having a screw connection;

FIG. 2 illustrates a perspective bottom view of the embodiment of FIG. 1;

FIG. 3 is a is a cross-section view of FIG. 2, showing the concave placement area;

FIG. 4 illustrates a perspective view of FIG. 3, showing a golf ball in its intended position along with a breach of a surface;

FIG. 10 illustrates a perspective view of another embodiment of the device according to the present invention, with the device being attached to a glass container having a crown or teeth connection;

FIG. 11 illustrates a perspective view of the device as in FIG. 10

FIG. 12 is a is a cross-section view of FIG. 11, showing the concave placement area;

FIG. 13 illustrates a perspective bottom view of the embodiment of FIG. 11; and FIG. 14 illustrates a perspective view of the device as in FIG. 10, that further illustrates a breach in a surface from the pointed tip along with a golf ball in its intended position.

DETAILED DESCRIPTION OF THE PREFERRED EMBODIMENTS

Figures 5, 6, 7, 8, 9:
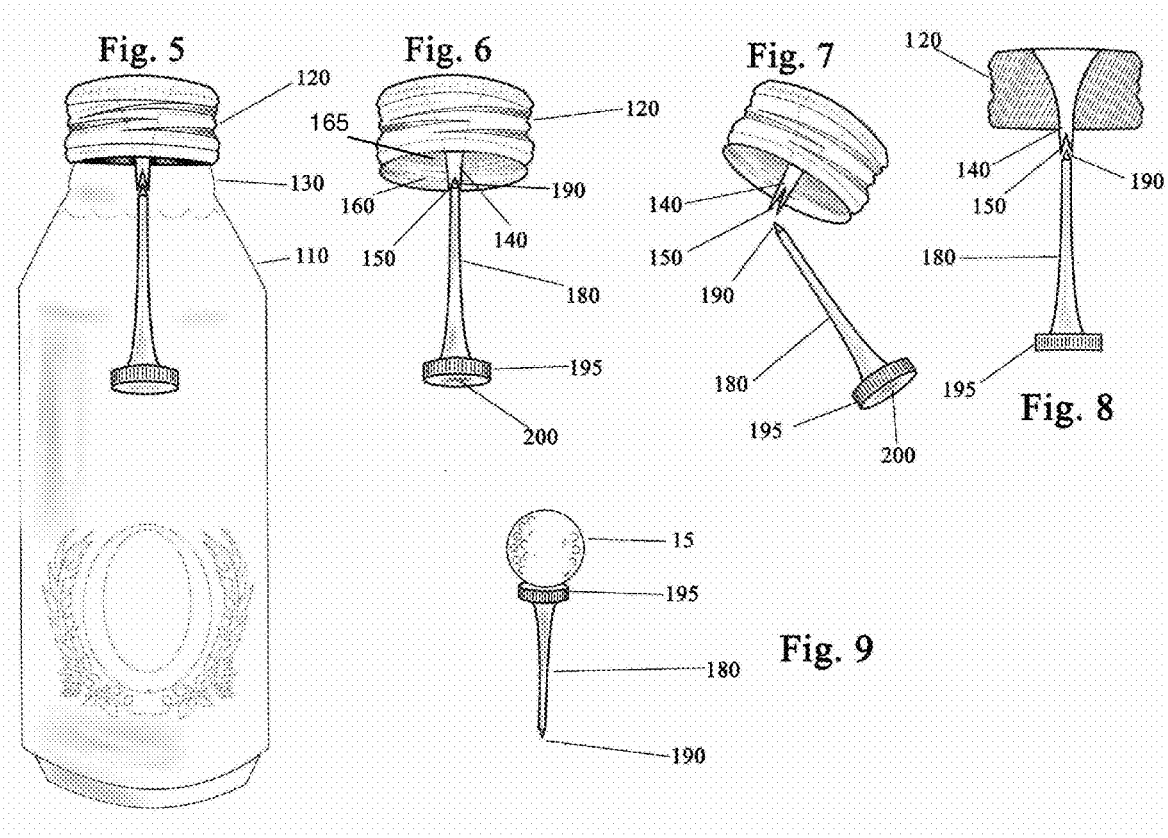
FIG. 5 illustrates a perspective view of another embodiment of the device according to the present invention, with the device being attached to an aluminum container having a threaded connection.
FIG. 6 illustrates a perspective view of the embodiment of FIG. 5, that further illustrates a protruding member coupled to a pointed tip.
FIG. 7 illustrates a perspective view of the embodiment of FIGS. 5 and 6, that further illustrates the separation between the protruding member and pointed tip.
FIG. 8 is a cross-section view of FIG. 5, showing the protruding member's association with the beverage cap.
FIG. 9 illustrates a perspective view of the detached tee as in FIG. 7, that further illustrates a golf ball in its intended position.

Referring now in detail to the drawings for the purpose of illustrating preferred embodiments of the present invention, the combined beverage closure and golf tee as shown in FIG. 1 comprises a plastic bottle 17, a plastic bottleneck 30, a screw cap 20 and a concave top section 25. FIGS. 2, 3 and 4 further illustrate the plastic screw cap 20 having an outside section 40 a bottom section 70 and an inside sidewall 50. The sidewall 50 includes continuous lugs 60 that are secured and connected to receptors on the top portion of the plastic bottleneck 17. The center of the bottom section 70 emits a tapering body member 80 which ends in a pointed tip 90.

As shown in FIG. 3, the plastic screw cap 20 has a placement area 100 on the concave top section 25. A tapering body 80, ending in a pointed tip 90, trails the placement area. FIG. 4 further demonstrates the positioning of a golf ball 15 on the placement area 100 at the top section 25 of the plastic screw cap 20. The tapering body 80 is able to extend beyond a surface 16 after being breached by the pointed tip 90.

Originally, the product looks and functions as a regular beverage container having a bottle with some sort of liquid matter and a cap to seal the bottle, aside from the concave top section 25. This embodiment is manufactured in such a way so that the tapering body 80 extends out of the bottom section 70 of the plastic screw cap 20. The tapering body 80 and plastic screw cap 20 are one solid piece, made of a material determined by the manufacturer and complying with safety food standards. A person in use of the device needs to unscrew the plastic screw cap 20 from the plastic bottle 17. Once unscrewed, the plastic bottle cap 20 inadvertently resembles a golf tee and can be used for such purposes. Due to the product being a single piece, once the tapering body 80 or pointed tip 90 come into contact with an unsanitary substance, the plastic screw cap 20 should not be reused as a sealer for the plastic bottle 17.

Another embodiment of the invention is depicted in FIGS. 5, 6, 7, 8 and 9. FIG. 5 illustrates an aluminum container 110 with an aluminum neck 130 and an aluminum thread cap 120. FIG. 6 removes the aluminum container 110 to give a better understanding of this embodiment. The aluminum thread cap 120 has a bottom section 125 and an inside wall 135. The inside wall 135 comprises continuous thread 160 which is capable of securing and locking onto the aluminum neck 130. The bottom section 165 of the aluminum thread cap 120 yields a protruding member 140. The end of the protruding member 140 has a perforated section 150 that is loosely connected to a pointed end 190. The pointed end 190 extends out into a widening body 180, which concludes in a tee top 195. The tee top has a concave placement area 200. Alternatively, the pointed end 190 can simply be connected to the bottom section 165 of the aluminum thread cap 120, without the need of a protruding member 140.

FIG. 7, further illustrating the embodiment of FIGS. 5 and 6, shows the separation that occurs between the protruding member 140 and the pointed end 190. The pointed end 190 is detached along the perforated area 150. When disconnected the structure of the golf tee remains unchanged including a pointed end 190, a widening body 180 and a tee top 195 having a placement area 200. As shown in FIG. 8, the aluminum thread cap 120 and the protruding member 140 are one piece, the protruding member 140 extending from the bottom center 165 of the aluminum thread cap 120. FIG. 9 further illustrates the detached part in an upright position with a golf ball 15 resting on the placement area 200 of the tee top 195. The pointed end 190 purposefully retains its structure in order to breach surfaces. The aluminum thread cap 120, after separation, can retain its primary objective of sealing the aluminum container 110 by linking the continuous threads 160 correlating with those on the top of the aluminum neck 130.

This second embodiment depicts an aluminum, or like-material, bottle with a threaded cap that can continually be loosened and tightened to form a seal. Originally, before first opening the bottle, the tee, which is attached to the protruding member 140, is encompassed in whatever liquid the aluminum container 110 holds. The product is manufactured in such a way that the aluminum thread cap 120 and the protruding member 140 are a single, inseparable piece. A user of the product unscrews the aluminum thread cap 120 and retracts all the members that are attached to the protruding member 140 through the perforated section 150. The widest part, the tee top 195, will have a diameter smaller than the aluminum neck 130, so as to allow easy withdrawal. Once taken out, the user simple snaps off or breaks apart the pointed end 190 from the perforated section. This task should require minimum difficulty because of the loose connection between the protruding member 140 and the pointed end 190. The user then can reseal the aluminum container 110 with the thread cap 120.

The final embodiment, featured in FIGS. 10, 11, 12, 13 and 14, portrays a glass container 210 with a glass neck 230 and a metal crown cap 220. The crown cap 220 consists of a placement area 300 inside the concave top section 240, a bottom section 270 and cap teeth 260 along the sidewall 250. Originally, the cap teeth 260, before taking off the crown cap 220, secure the top of the glass neck 230. A tapering member 280 extends from the center of the bottom section 270. The tapering member concludes in a pointed end 290. The placement area 300 permits a golf ball to rest on top of the concave top section 220 while a golfer strikes the ball. Further, the pointed top 290 is specifically made to allow a user to breach a surface 16. Such surface 16 can be the ground on a golf course, as depicted in FIG. 14, or an alternative forgiving exterior of which the user desires.

Originally, the product looks and functions as a regular glass beverage container having a glass bottle with some sort of liquid matter and a metal cap to seal the bottle, aside from the concave top section 240. This embodiment is manufactured in such a way so that the tapering member 280 extends out of the bottom section 270 of the metal crown cap 220. The tapering member 280 and metal crown cap 220 are one solid piece made of a material determined by the manufacturer and complying with safety food standards. A person in use of the device needs to twist off the metal crown cap 220 from the glass container 210. Once twisted off, the metal crown cap 220 inadvertently resembles a golf tee and can be used for such purposes. Unlike the other embodiments, the metal crown cap 220 cannot be reattached to the glass container 210. However, the user should still not try to place the cap 220 back onto the container 210 after the original unsealing.

Additional features of the device may be added by those skilled in the art of the invention, thus the invention should not be limited by the embodiments shown in the drawings. It is to be appreciated that alternative embodiments of the generalized embodiment might include other modifications or alterations without departing from the spirit and scope of the present invention. For example, the size, shape, orientation and/or materials of the various components may be changed to achieve different effects without departing from the spirit and scope of the invention. Thus, the scope of the invention should not be limited by the specific structures disclosed but instead the true scope of the invention should be limited only by the following claims.

What is claimed is:

1. A combined beverage closure and detachable golf tee for supporting golf balls comprising:

a beverage container made of a material consisting at least one of glass, metal or plastic for containing a liquid substance;

the beverage container further comprising a receptive threaded container neck of a container opening capable of receiving and fastening a container closure;

the container closure further comprising an outside holding surface and a container head to enable the prevention of leakage of liquids when attached to the beverage container;

an inner surface and an inside wall threaded area of the container closure engaging corresponding threads on the opening of the beverage container capable of fastening the beverage container by threading one over the other;

a pointed end loosely connected to the inner surface of the closure, whereby the connection is fragile and easily disengaged;

a longitudinal widening body member extending from the pointed end resembling a golf tee;

a tubular beveled head at the end of the widening body member adapted to be used as a placement area for a golf ball, whereby the placement area is specifically adapted to receive and support a golf ball; and said beveled head having a smaller diameter as compared to the container opening from its center in order to permit removal in an upward direction away from the opening.

2. The apparatus of claim 1, further comprising a protruding member having a first end connected to the inner surface of said closure, a second v-shaped end and a perforated section along the second end of the protruding member having a perforated segment at the tip made of frangible material that is loosely connected to the pointed end.

3. The apparatus according to claim 1, consisting essentially of a food grade material used as the primary element of the widening body member so as to provide a sanitary object within a liquid.

4. The apparatus according to claim 1, further comprising of a recyclable material used as the primary element of the widening body member.

* * * * *